US006164760A

United States Patent [19]

Mizoguchi et al.

[11] Patent Number: 6,164,760

[45] **Date of Patent: *Dec. 26, 2000**

[54] TONER QUANTITY DETECTION AND REPLENISHMENT SYSTEM FOR AN ELECTROSTATIC INK JET RECORDING APPARATUS

[75] Inventors: Tadashi Mizoguchi; Hitoshi Takemoto; Junichi Suetsugu; Hitoshi Minemoto; Kazuo Shima; Yoshihiro Hagiwara; Toru Yakushiji, all of Niigata, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,683

[22] Filed: Nov. 5, 1997

[30] Foreign Application Priority Data

Nov. 6, 1996 [JP] Japan ..... 8-293905

[51] Int. Cl.[7] ..... B41J 2/06

[52] U.S. Cl. ..... 347/55

[58] Field of Search ..... 347/55, 154, 103, 347/123, 111, 159, 127, 128, 17, 141, 120, 151; 399/271, 290, 292, 293, 294, 295

[56] References Cited

FOREIGN PATENT DOCUMENTS

| | | | |
|---|---|---|---|
| 0 703 080 | 3/1996 | European Pat. Off. | 347/55 |
| 56-167473 | 12/1981 | Japan . | |
| 93/11866 | 6/1993 | WIPO . | |

*Primary Examiner*—John Barlow
*Assistant Examiner*—Raquel Yvette Gordon
*Attorney, Agent, or Firm*—Foley & Lardner

[57] ABSTRACT

The quantity of toner particles in an ink is detected by a toner quantity detector. The quantity of toner particles is integrated for a predetermined time period by a controlling portion. The integrated value is compared with a reference value. When the integrated value is smaller than the reference value, a value is opened for a predetermined time period so as to supply a toner in a toner replenisher to an ink tank. Thus, a predetermined quantity of the toner is replenished to the ink tank. After the toner has been replenished, when the integrated value does not become larger than the reference value, a valve is opened for a predetermined time period under the control of the controlling portion so as to replenish a charge control agent from a charge control agent replenisher to the ink tank.

19 Claims, 4 Drawing Sheets

TONER QUANTITY DETECTION AND REPLENISHMENT SYSTEM FOR AN ELECTROSTATIC INK JET RECORDING APPARATUS

BACKGROUND OF THE INVENTION

1. Field of the Invention

The present invention relates to an electrostatic ink jet recording apparatus, in particular, to an electrostatic ink jet recording apparatus that is used for a printer, a facsimile machine, a copy machine, and so forth and that uses an ink of which toner particles are dispersed in a carrier solution and jetted by an electrostatic force.

2. Description of the Related Art

A variety of ink jet recording systems have been proposed because of their advantages such as direct recording on plain paper and low noise. As one of such systems, an ink recording head has been disclosed as Japanese Patent Laid-Open Publication No. 56-167473. With reference to FIG. 6, the structure of the related art reference will be described.

In an ink jet recorder, a large number of electrodes 52 are placed at an inner side of an ink jet port 51 of a recording head. Ink in the jet port 51 is selectively jetted through the port by selectively applying a high voltage pulse between the electrodes 52 and a grounded conductor 59 at the side of record paper 60 corresponding to a picture signal. In the ink jet recorder, the jet port 51 is divided into an upper part 51*a* and a lower part 51*b* with a partition 55 in the slit-form jet port 51, which is formed with an upper plate 56 and a lower plate 57. A large number of electrodes 52 are disposed at the inside of divided jet ports 51*a* and 51*b* (upper plate and lower plate surfaces and/or the surfaces of the divided plates). By applying a high voltage to some electrodes and a low voltage to an electrode positioned on the right or left of the electrode, and ink jet dot moves to the high voltage side.

Ink placed in an ink chamber 54 reaches the ink ejection port 51. The ink at the ink jet port 51*a* and 51*b* forms a linear meniscus. When a high voltage of around 2 kV is applied from a terminal 58 to a selected electrode 52, the ink is jetted from the position of the electrode at which such a high voltage is applied. The ink is accelerated by an electric field with a conductive roller 59 and then adhered to record paper 60. Thus, by selecting a plurality of electrodes and applying a high voltage thereto at the same time, a pattern of one line can be recorded. With the record paper 60 moved, characters, figures, and so forth can be recorded as dots of the ink.

Another related art reference that has been disclosed as PCT Laid-Open Publication NO. WO 93/11866 is an electrostatic ink jet recording apparatus. The apparatus comprises an electrostatic ink jet recording head and a counter electrode. The counter electrode causes an electric field to be formed with a counter electrode against the ink jet recording head disposed on the rear surface of the record paper. The ink jet recording head has an ink chamber and an ejection electrode. The ink chamber temporarily stores an ink solution supplied from an ink tank or the like. The ejection electrode is disposed at an edge portion of the ink chamber. The ink jet recording head is disposed opposite to the counter electrode. The ink solution in the ink chamber is supplied to the edge of the ejection electrode due to the surface tension. Thus, an ink meniscus is formed at the edge of the ejection electrode. The ink solution used for the ink jet recording head contains a coloring charge particles. The charge particles are positively charged with a zeta voltage.

When a positive voltage is applied to the ejection electrode, the voltage of the ink solution increases. When Coulomb force that works between the charge particles at the edge of the ejection electrode and the counter electrode largely exceeds the surface tension of the ink solution, agglomeration of the charge particles with a small amount of ink solution is jetted from the edge position of the ejection electrode to the counter electrode. The charge particles adhere to the front surface of the record medium. In such a method, with the voltage to the ejection electrode, agglomeration of the charge particles is successively jetted from the edge of the election electrode to the front surface of the record medium and thereby data is recorded.

SUMMARY OF THE INVENTION

FIGS. 4 and 5 show the structure of a recording head portion of a related electrostatic ink jet recording apparatus. FIG. 4 is a perspective view showing the structure in developing recording apparatus. FIG. 5 is a sectional view seen from the direction A of FIG. 4.

Ink that flows in the recording head portion is supplied from an ink tank (not shown) to the inside of a head 42 through an ink entrance port 41. Thereafter, the ink is supplied to an ejection electrode 43. The ink that has been supplied to the ejection electrode 43 returns to an ink tank (not shown) through an ink exit port 44.

The toner particles in the ink are charged with the same polarity as the voltage applied to the ejection electrode 43 by a charge control agent. An opposite electrode 46 is disposed opposite to an ejection opening portion 45. The voltage of the opposite electrode 46 is lower than the voltage of the ejection electrode 43. A voltage with the same polarity as the toner particles is applied to a migration electrode 47. When the voltage is applied to the migration electrode 47, the toner particles in the ink travel to the ejection opening portion 45. In the state that the toner particles congregate at the ejection opening portion 45, when a voltage is applied to the ejection electrode 43, the electrostatic force that takes place between the ejection electrode 43 and the opposite electrode 46 causes the toner particles to move to the opposite electrode 46. Thus, the toner particles adhere to the record medium 48 disposed between the ejection electrode 43 and the opposite electrode 46.

A gate electrode 49 disposed between the record medium 48 and the ejection opening portion 45 helps move the toner particles and thereby contributes to decreasing the voltage applied to the ejection electrode 43.

In the conventional electrostatic ink jet recording apparatus, the concentration of toner particles in the ink affects the printing density.

In the case of a head that has a relatively large ink tank that stores ink, the ink tank functions as a buffer. Since the migration electrode causes the toner particles in the ink tank to move to the ejection portion, the fluctuation of the concentration of the toner particles in the ink does not largely affect the printing density.

However, in the case of a head that does not have a proper ink tank and of which the ink flows in an ejection electrode portion, the quantity of toner particles in the ink flow largely affects the printing density. In this head, a small fluctuation of the concentration of toner particles results in decreasing or increasing the printing density. In other words, in such a head, the printing quality is not stable.

An object of the present invention is to provide an electrostatic ink jet recording apparatus that allows the quantity of toner particles and the quantity of a charge control agent to be properly controlled so as to obtain a good printing density.

An electrostatic ink jet recording apparatus according to the present invention comprises a toner quantity detecting means for detecting the quantity of toner particles in the ink, a toner quantity determining means for determining whether or not the detected quantity of toner particles is sufficient, and a replenishing means for replenishing the toner particle to the ink corresponding to the determined result.

In the electrostatic ink jet recording apparatus according to the present invention, the toner quantity detecting means may be a magnetic sensor.

In the electrostatic ink jet recording apparatus according to the present invention, the toner quantity detecting means may be composed of a light emitting device and a light receiving device.

In the electrostatic ink jet recording apparatus according to the present invention, the toner quantity detecting means may be an integrating circuit.

The electrostatic ink jet recording apparatus according to the present invention may further comprises a controlling means for converting a value of which the detected quantity of toner particles is integrated for a predetermined time period from an analog value into a digital value and controlling a replenishment quantity of the toner corresponding to the digital value.

The electrostatic ink jet recording apparatus according to the present invention may further comprises a charge control agent replenishing means for replenishing a charge control agent to the ink when the concentration of the toner does not exceed a reference value after a predetermined quantity of the toner has been replenished to the ink.

In the electrostatic ink jet recording apparatus according to the present invention, the toner replenishing means may replenish a charge control agent in addition to the toner.

These and other objects, features and advantages of the present invention will become more apparent in light of the following detailed description of best mode embodiments thereof, as illustrated in the accompanying drawings.

DESCRIPTION OF PREFERRED EMBODIMENTS

Figure 1:
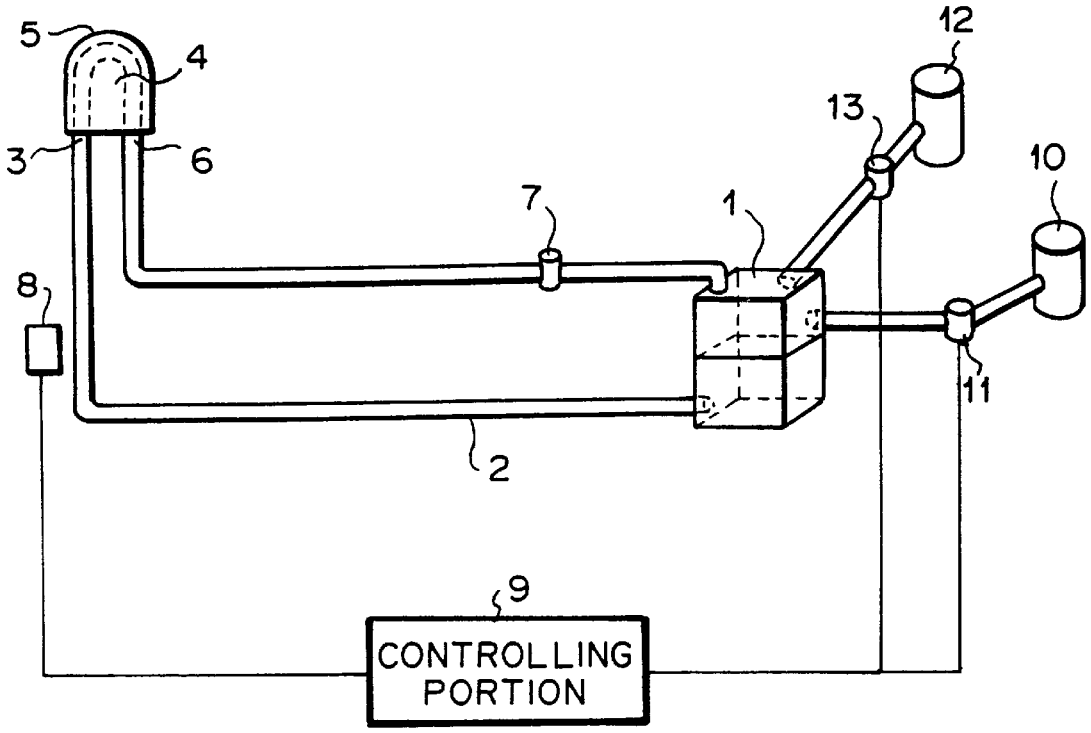
FIG. 1 is a schematic diagram showing the structure of an electrostatic ink jet recording apparatus according to a first embodiment of the present invention.

FIG. 1 is a block diagram showing the structure of an electrostatic ink jet recording apparatus according to a first embodiment of the present invention. Referring to FIG. 1, an ink that contains toner particles is supplied from an ink tank 1 to an ink entrance port 3 through a pipe 2. The ink flows in a head 4. The ink exits from an ink exit port 6 through an ejection opening portion 5. Thereafter, the ink is returned to the ink tank 1 by a pump 7. The head 4 is moved perpendicular to the moving direction of a record medium (not shown) by a motor, a belt, and so forth (not shown). With these structural portions, characters, figures, and so forth are printed on the entire record medium.

Referring to FIG. 1, a toner quantity detector 8 that detects the quantity of toner particles in the ink is disposed near by the ink entrance port 3 and in the vicinity of the pipe 2. The toner quantity detector 8 may be disposed in the head 4 close to the ejection portion.

The toner quantity detector 8 shown in FIG. 1 is composed of a magnetic sensor. The toner quantity detector 8 detects a magnetic field that is generated when charged toner particles in the ink flow. When the quantity of toner particles in the ink is large, the magnetic force becomes strong. When the quantity of toner particles in the ink is small, the magnetic force becomes weak. A controlling portion 9 determines whether or not the quantity of toner particles is large.

Figure 2:
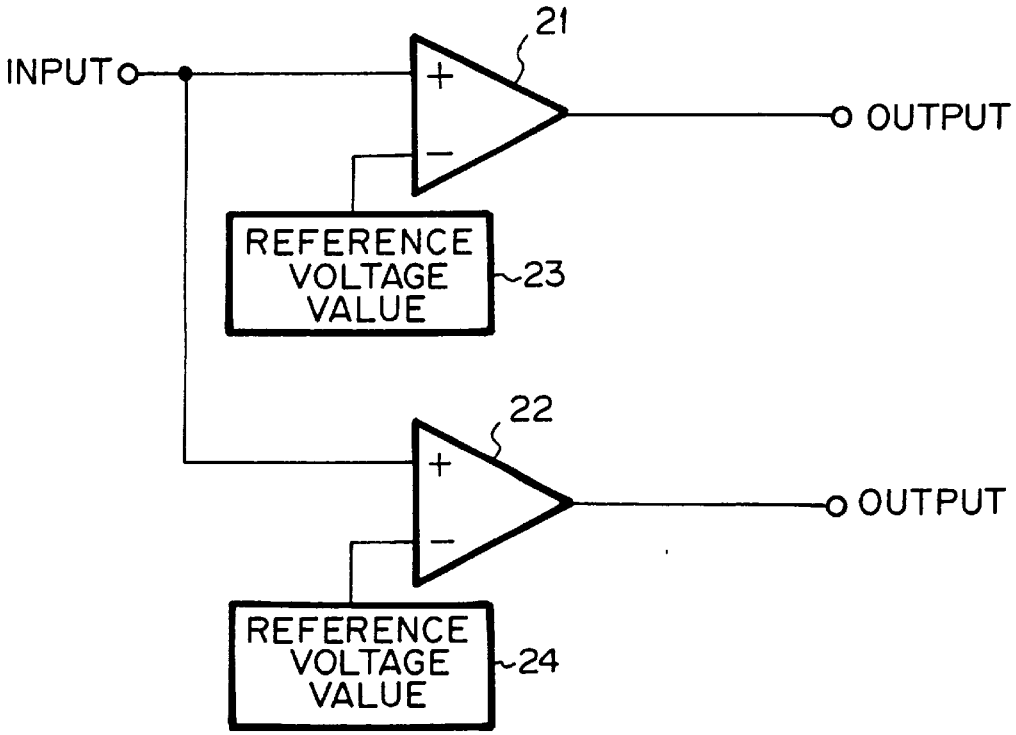
FIG. 2 is a circuit diagram for explaining an example of the circuit of a determining portion that determines whether or not the quantity of toner particles is large.

The quantity of toner particles detected by the toner quantity detector 8 is integrated for a predetermined time period by the controlling portion 9. A comparator of the controlling portion 9 compares the integrated value and a reference value of the comparator. FIG. 2 is a circuit diagram for explaining an example of a circuit of a determining portion that determines whether the quantity of toner particles is large. The determining portion is disposed in the controlling portion 9. For example, the integrated value integrated by the circuit shown in FIG. 2 is compared with a reference voltage value 23 and a reference voltage value 24 by a comparator 21 and a comparator 22, respectively. There is the relation of reference voltage value 24<reference voltage value 23. When the integrated value is between the reference voltage value 23 and the reference voltage value 24, the quantity of toner particles in the ink is sufficient for a predetermined printing density. When the integrated value is lower than the reference voltage value 24, the quantity of toner particles is small. Thus, the toner should be replenished. When the integrated value is larger than the reference voltage value, the signal level of the output signal of each comparator becomes "High". When the integrated value is smaller than the reference voltage value, the signal level of the output signal of each comparator becomes "Low". The output values are sent to a CPU of the controlling portion 9.

When the signal level of the output signal of the comparator 22 is "Low" (namely, the integrated value detected by the toner quantity detecting portion 8 is lower than the reference voltage value 24), the toner should be replenished to the ink. In this case, as shown in FIG. 1, a valve 11 is opened for a predetermined time period under the control of the controlling portion 9 so as to replenish the toner from a toner replenisher 10 to the ink tank 1. Thus, a predetermined quantity of the toner is replenished to the ink tank 1. Normally, this operation is repeated three times so as to accomplish the sufficient printing density. Consequently, the integrated value of the output signal of the toner quantity detector 8 becomes larger than both the reference voltage value 24 and the reference voltage 23.

After the toner has been replenished by opening the valve 11 for example five times, when the integrated value is not larger than the reference voltage value 24, the quantity of a discharge control agent is small and thereby the toner particles are not sufficiently charged. In this case, a valve 13 is opened for a predetermined time period under the control of the controlling portion 9 so as to replenish the charge control agent from a charge control agent replenisher 12 to the ink tank 1. Thus, the toner particles are sufficiently charged and thereby the integrated value of the output value of the toner quantity detecting unit 8 becomes a normal value that exceeds the reference voltage value 24.

In the above-described embodiment, two comparators were used. However, with one comparator as an intermediate value of the reference value 23 and the reference value 24, the quantities of a toner and a charge control agent may be controlled. In addition, in the above-described embodiment, a toner and a charge control agent were replenished through respective pipes. However, they may be replenished in various manners.

Figure 3:
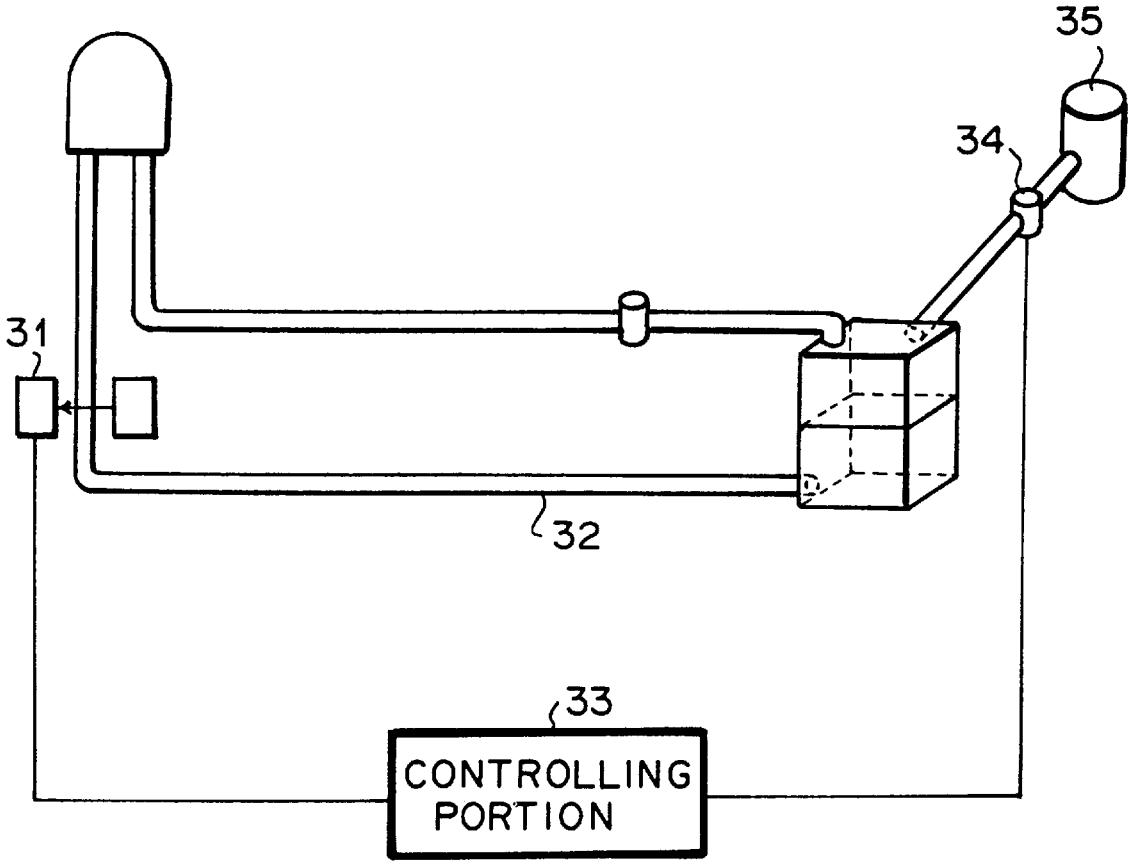
FIG. 3 is a schematic diagram showing the structure of an electrostatic ink jet recording apparatus according to a second embodiment of the present invention.
Figure 4:
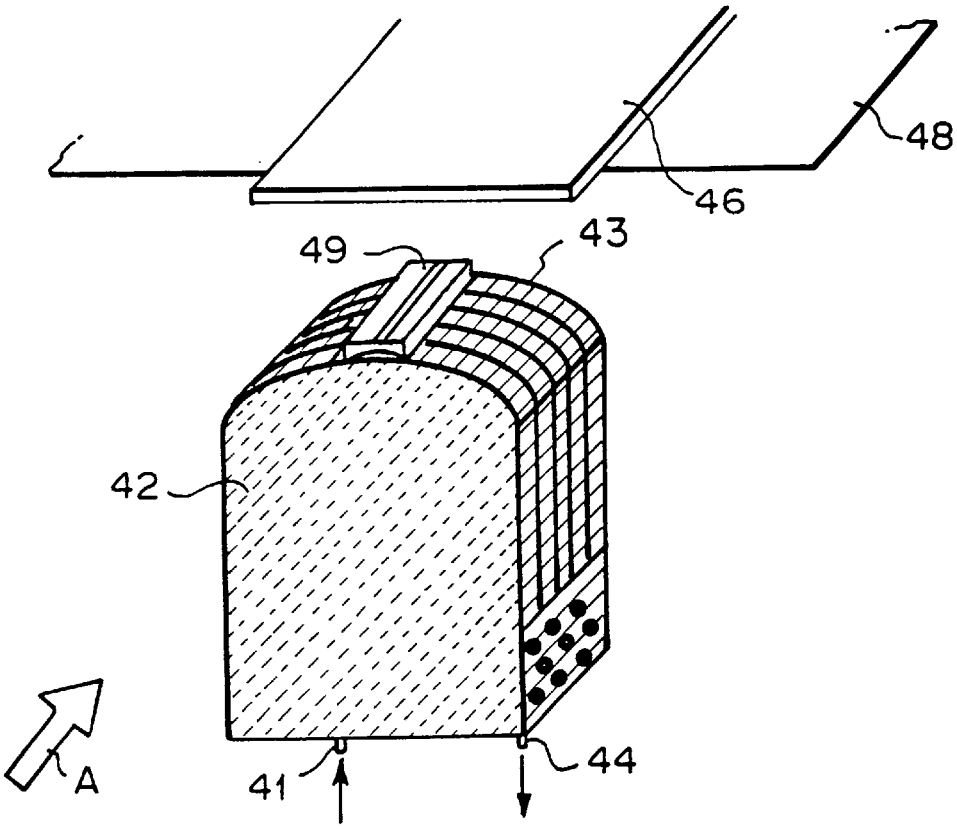
FIG. 4 is a perspective view showing a recording head of a electrostatic ink jet recording apparatus related to the present invention.
Figure 5:
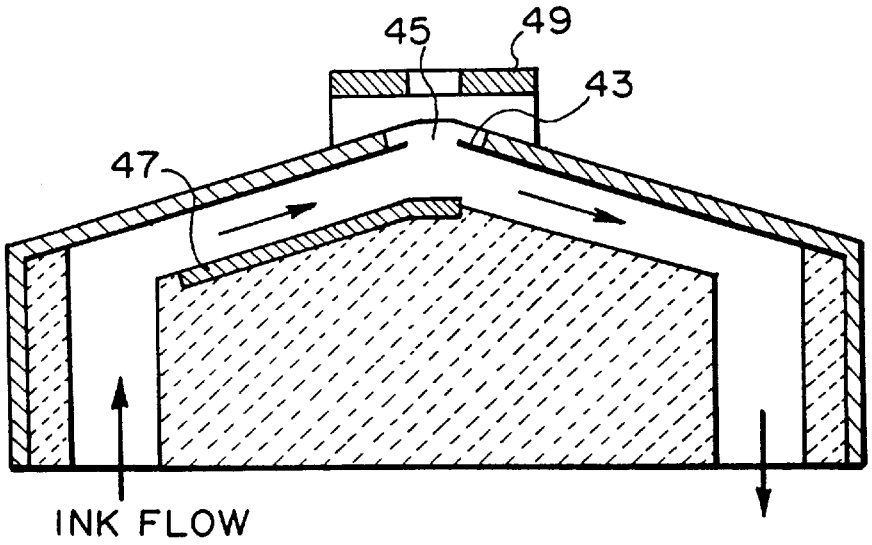
FIG. 5 is a sectional view of FIG. 4.
Figure 6:
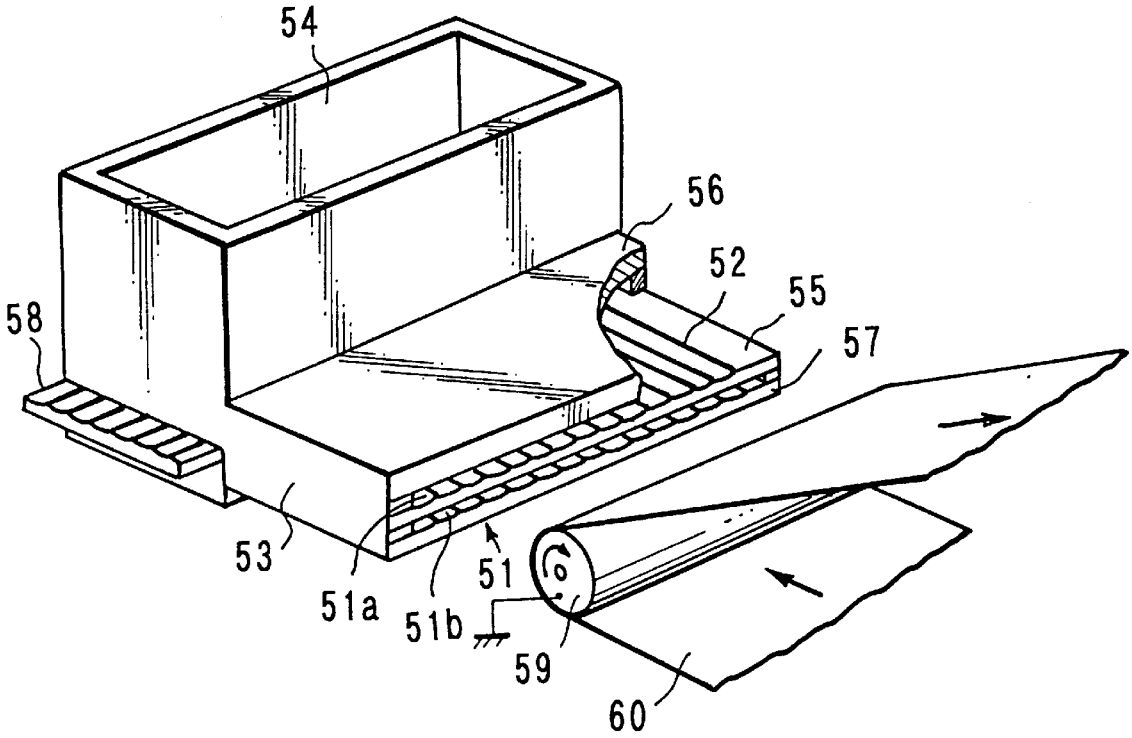
FIG. 6 (PRIOR ART)
FIG. 6 is a perspective view showing the structure of a conventional ink recording apparatus.

FIG. 3 is a block diagram showing the structure of an electrostatic ink jet recording apparatus. Referring to FIG. 3, a toner quantity detector 31 is composed of a light emitting device and a light receiving device. With these devices, the quantity of toner particles that flow in a transparent pipe 32 is detected. When the quantity of toner particles that flow in the pipe 32 is large, the amount of light that enters the light receiving device becomes small. When the quantity of toner particles that flow in the pipe 32 is small, the amount of light that enters the light receiving device becomes large.

A controlling portion 33 determines whether or not the quantity of toner particles is large. The controlling portion 33 integrates the detected quantity of toner particles for a predetermined time period and converts the integrated value as an analog value into a digital value. Thus, the toner to be replenished can be precisely controlled. For example, assuming that the A/D conversion is represented with two bits, that is, four stages, in the first stage, the valve 34 is opened five times. In the second stage, the valve 34 is opened three times. In the third stage, the valve 34 is opened one time. In the fourth stage, the valve 34 is opened 0-th time (namely, the valve 34 is closed). It should be noted that the number of bits of the A/D conversion is not limited to two bits.

In FIG. 3, the toner replenisher 35 contains a charge control agent. Thus, the structure of the second embodiment becomes simpler than the structure of the first embodiment.

As described above, according to the present invention, since the quantity of toner particles in an ink is detected and determined whether or not it is large and thereby the quantities of a toner and a charge control agent are controlled so that they are sufficient, a proper printing density can be always accomplished.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. An electrostatic ink jet recording apparatus comprising:

an ink that contains charged toner particles;

an ejection electrode for ejecting the toner particles in the ink from an ejection opening portion to a record medium;

an opposite electrode disposed opposite to the ejection opening portion through the record medium;

an ink tank for supplying said ink to the ejection operating portion through a pipe;

toner quantity detecting means for detecting a quantity of toner particles in an ink flow in the pipe;

toner quantity determining means for determining whether or not the detected quantity of toner particles is sufficient; and replenishing means connected to said toner quantity determining means for automatically replenishing the toner particles to the ink flow corresponding to the determined result, said replenishing means having at least one valve and at least one toner replenisher for adding toner to said apparatus.

2. The electrostatic ink jet recording apparatus as set forth in claim 1, wherein said toner quantity detecting means in the ink flow is a magnetic sensor.

3. The electrostatic ink jet recording apparatus as set forth in claim 2, wherein said toner quantity detecting means in the ink flow includes an integrating circuit.

4. The electrostatic ink jet recording apparatus as set forth in claim 5, further comprising:

controlling means for converting a value of which the detected quantity of toner particles is integrated for a predetermined time period from an analog value into a digital value and controlling a replenishment quantity of the toner particles corresponding to the digital value.

5. The electrostatic ink jet recording apparatus as set forth in claim 4, further comprising:

charge control agent replenishing means for replenishing a charge control agent to the ink flow when the quantity of the toner particles does not exceed a reference value after a predetermined quantity of the toner particles has been replenished to the ink flow.

6. The electrostatic ink jet recording apparatus as set forth in claim 4, wherein said toner replenishing means replenishes a charge control agent in addition to the toner particles.

7. The electrostatic ink jet recording apparatus as set forth in claim 3, further comprising:

charge control agent replenishing means for replenishing a charge control agent to the ink flow when the quantity of the toner particles does not exceed a reference value after a predetermined quantity of the toner particles has been replenished to the ink flow.

8. The electrostatic ink jet recording apparatus as set forth in claim 3, wherein said toner replenishing means replenishes a charge control agent in addition to the toner particles.

9. The electrostatic ink jet recording apparatus as set forth in claim 2, further comprising:

charge control agent replenishing means for replenishing a charge control agent to the ink flow when the quantity of the toner particles does not exceed a reference value after a predetermined quantity of the toner particles has been replenished to the ink flow.

10. The electrostatic ink jet recording apparatus as set forth in claim 2, wherein said toner replenishing means replenishes a charge control agent in addition to the toner particles.

11. The electrostatic ink jet recording apparatus as set forth in claim 1, wherein said toner quantity detecting means in the ink flow is composed of a light emitting device and a light receiving device.

12. The electrostatic ink jet recording apparatus as set forth in claim 11, wherein said toner quantity detecting means in the ink flow includes an integrating circuit.

13. The electrostatic ink jet recording apparatus as set forth in claim 12, further comprising:

controlling means for converting a value of which the detected quantity of toner particles is integrated for a predetermined time period from an analog value into a digital value and controlling a replenishment quantity of the toner particles corresponding to the digital value.

14. The electrostatic ink jet recording apparatus as set forth in claim 11, wherein said toner replenishing means replenishes a charge control agent in addition to the toner particles.

15. The electrostatic ink jet recording apparatus as set forth in claim 1, further comprising:

charge control agent replenishing means for replenishing a charge control agent to the ink flow when the quantity of the toner particles does not exceed a reference value after a predetermined quantity of the toner particles has been replenished to the ink flow.

16. The electrostatic ink jet recording apparatus as set forth in claim 1, wherein said toner replenishing means replenishes a charge control agent in addition to the toner particles.

17. The electrostatic ink jet recording apparatus as recited in claim 1, wherein said replenishing means is connected to add toner to said tank by the way of said at least one valve.

18. The electrostatic ink jet recording apparatus as recited in claim 17, wherein said replenishing means further comprises a charge control agent replenisher and a second valve, said charge control agent replenisher connected to add a charge control agent to said tank by the way of said second valve.

19. The electrostatic ink jet recording apparatus as recited in claim 1 wherein said replenishing means includes means for automatically replenishing two different types of replenisher.

* * * * *